US007806732B1

(12) United States Patent
Yen

(10) Patent No.: US 7,806,732 B1
(45) Date of Patent: Oct. 5, 2010

(54) CONNECTOR ASSEMBLY

(76) Inventor: Hsu-Li Yen, 3F.-2, No. 13, Wucyuan 1st Rd., Sinjhuang City, Taipei County 242 (TW)

( * ) Notice: Subject to any disclaimer, the term of this patent is extended or adjusted under 35 U.S.C. 154(b) by 0 days.

(21) Appl. No.: 12/453,403

(22) Filed: May 11, 2009

(51) Int. Cl.
*H01R 13/648* (2006.01)

(52) U.S. Cl. ..... 439/660

(58) Field of Classification Search ..... 439/660, 439/108

See application file for complete search history.

(56) References Cited

U.S. PATENT DOCUMENTS 7,488,188 B2 * 2/2009 Moriyama et al. ..... 439/108
2009/0124134 A1 * 5/2009 Moriyama et al. ..... 439/660
2009/0149078 A1 * 6/2009 Kondo et al. ..... 439/660
2009/0186528 A1 * 7/2009 Chen ..... 439/660

* cited by examiner

*Primary Examiner*—Gary F. Paumen
(74) *Attorney, Agent, or Firm*—Rosenberg, Klein & Lee

(57) ABSTRACT

A connector assembly includes a socket connector and a signal output connector. The socket connector is configured for connection with an external electronic device, such as a computer or a mobile phone. The signal output connector is assembled with the socket connector. Terminals configured for multiple transmission functions are compactly standby-provided in the connector assembly to enable the connector assembly to be connected to various multi-functional interfaces.

3 Claims, 5 Drawing Sheets

CONNECTOR ASSEMBLY

BACKGROUND OF THE INVENTION

1. Technical Field

The present invention relates to connector assemblies, and more particularly, to a connector assembly comprising a socket connector for being connected with an external electronic device, e.g. a computer, or a mobile phone, and a signal output connector assembled with the socket connector.

2. Description of Related Art

Since the commencement of electronic technology, various electronic devices, such as mobile phones, digital cameras, PDAs, MP3 players and so on have been developed to meet people's multifarious needs. In early days, every electronic device usually came with a single function.

However, with the progress of electronic technology, electronic devices with multiple functions are getting more and more popular for the convenience and adaptability they provide.

Regarding a modern electronic device with multiple functions, it is necessary to have multiple connectors so as to provide transmission alternatives for different interface mechanisms. Traditionally, the more functions (such as audio playing, power supplying, image capturing, and data processing) the electronic device provides, the more connectors have to be provided to the electronic device. These connectors can significantly increase the size and weight of the electronic device, thus being unfavorable to people's desire for a compact and light electronic device.

Considering the defects of the existing connectors, the inventor of the present invention, aiming at creating a novel connector assembly that facilitates downsizing an electronic device having the same, and relying on his years of practical experience, after unceasing researches and repeated retrofit, herein discloses a connector assembly provided with diverse connector circuits integrated thereinto and configured for transmission enabled by multi-functional interfaces.

SUMMARY OF THE INVENTION

The present invention provides a connector assembly comprising a socket connector for being connected with an external electronic device, e.g. a computer, or a mobile phone, and a signal output connector assembled with the socket connector. The disclosed connector assembly is compactly standby-provided with terminals so as for the connector assembly to be connected to various multi-functional interfaces.

Thereby, the objective of the present invention to provide a connector assembly acting as a multi-function transmission interface, and facilitating reducing manufacturing costs and downsizing an electronic device having the same can be achieved.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE PREFERRED EMBODIMENTS

Figure 1:
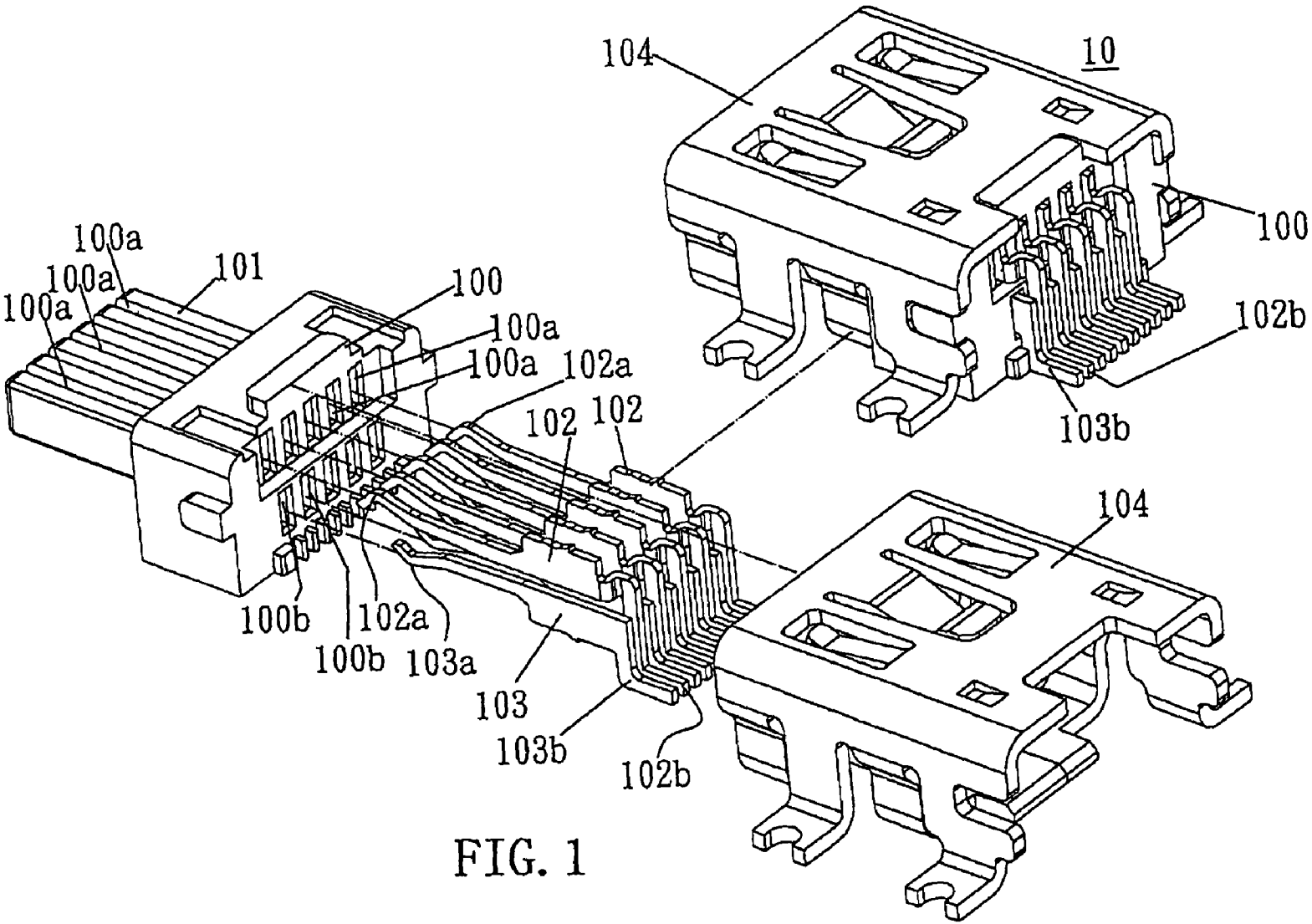
FIG. 1 includes an exploded view and an assembled view of a socket connector of a connector assembly according to the present invention.
Figure 3:
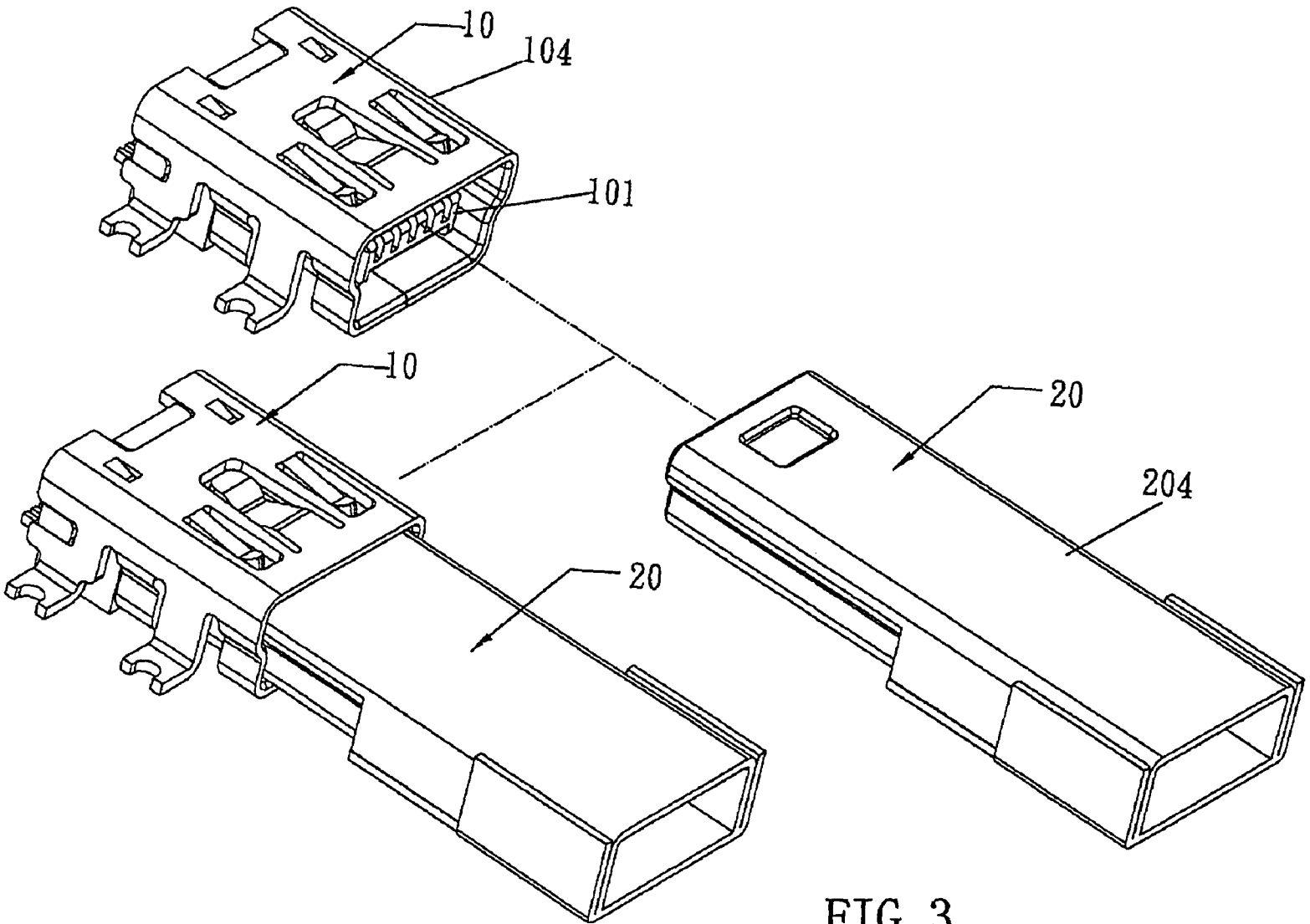
FIG. 3 shows the connector assembly assembled from one viewpoint.

FIG. 1 includes an exploded view and an assembled view of a socket connector 10 of a connector assembly according to the present invention. As shown in the drawing, the socket connector 10 comprises a base 100 with a tongue portion 101 extending frontward. A plurality of sockets A 100*a* and sockets B 100*b* spaced apart from and series-connected to one another and extending through and across the base 100 and the tongue portion 101 serve to receive a terminal set A 102 and a terminal set B 103 inserted and positioned therein, respectively. The socket connector 10 further comprises a housing 104 mounted on the assembled base 100 and terminal sets 102, 103, so that an accommodating recess is defined between a front end of the housing 104 and the tongue portion 101, as shown in FIG. 3.

The terminal set A 102 and terminal set B 103 each have a plurality of terminals. Each of the terminals has a front end formed with an outward jutting portion 102*a* or 103*a* and a rear end formed as a soldering pin 102*b* and 103*b*.

Figure 2:
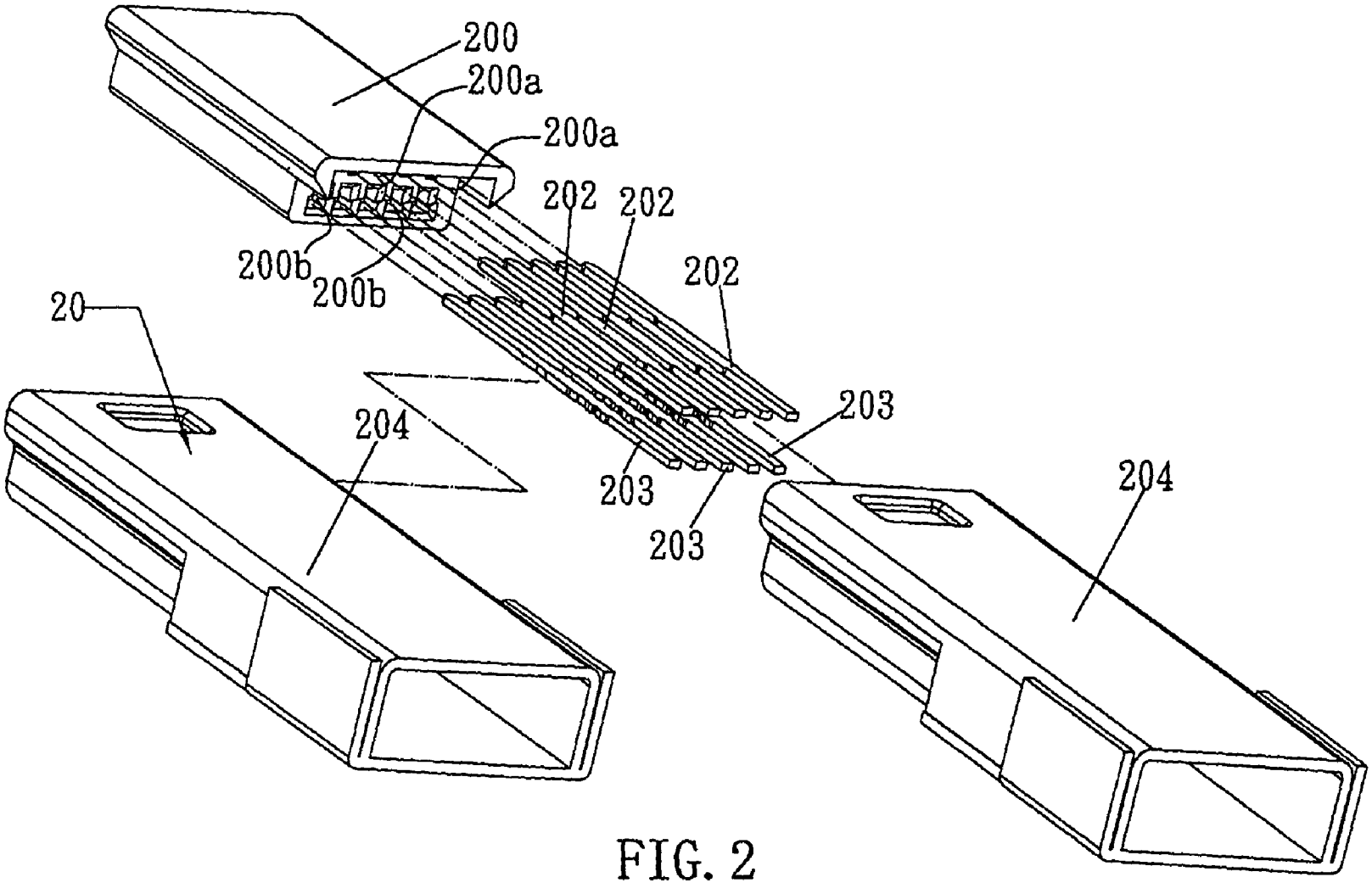
FIG. 2 includes an exploded view and an assembled view of a signal output connector of the connector assembly according to the present invention.
Figure 4:
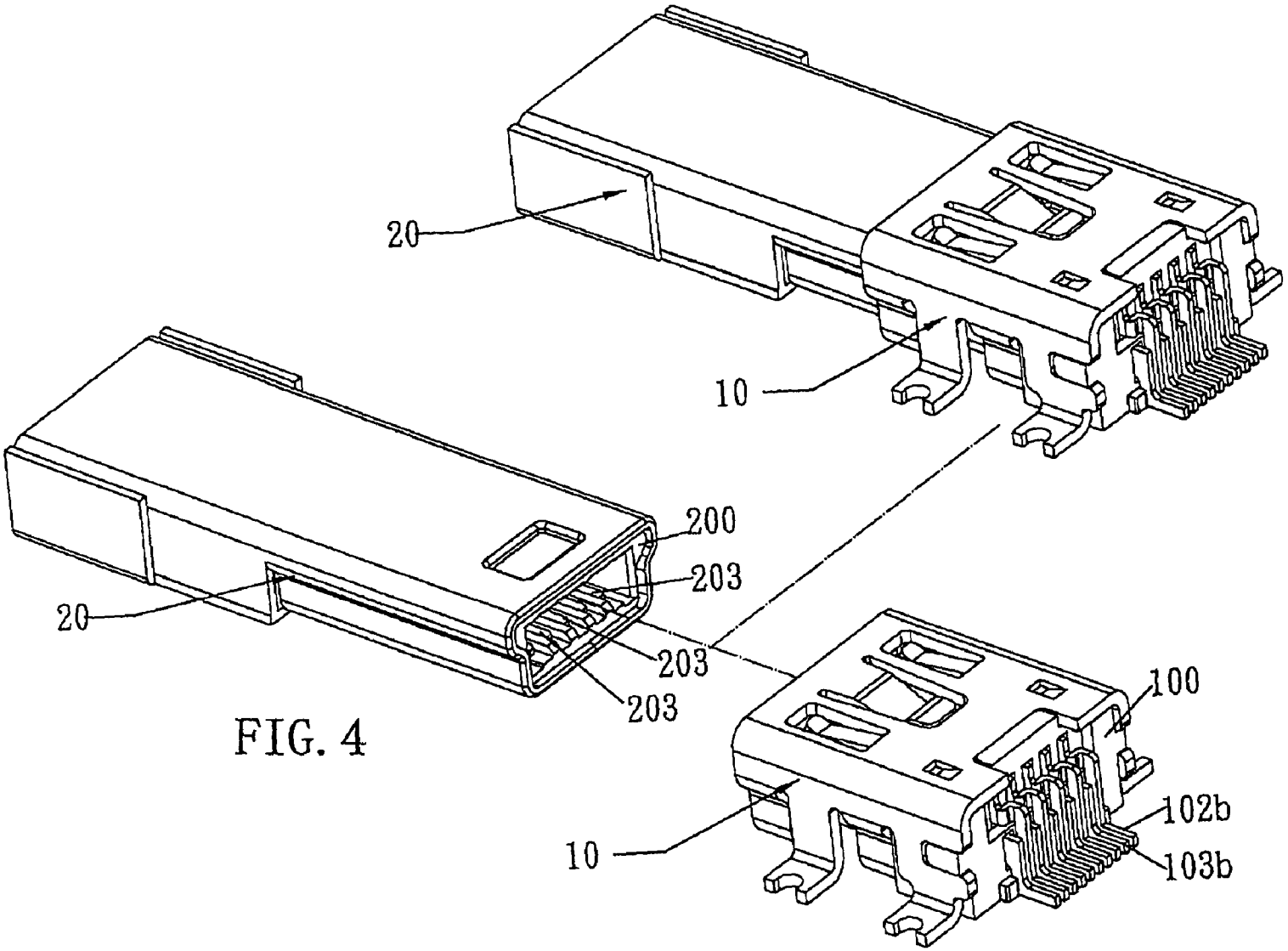
FIG. 4 shows the connector assembly assembled from another viewpoint.
Figure 6:
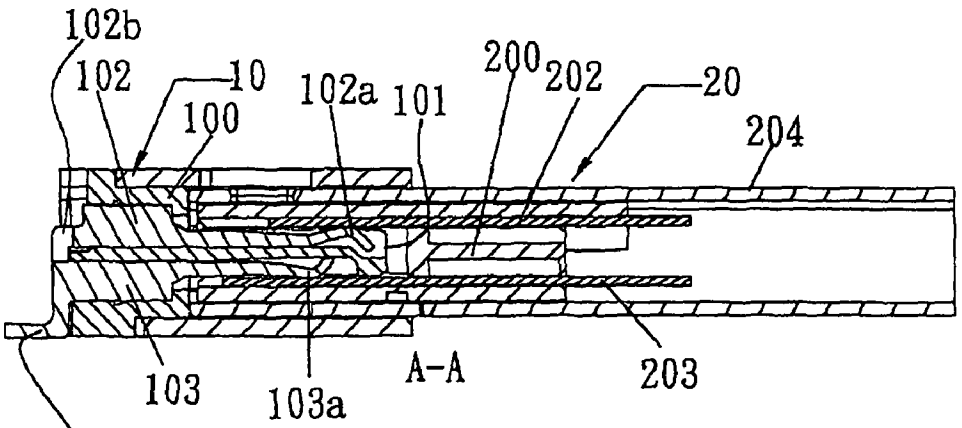
FIG. 6 is a sectional view of the connector assembly taken along Line A-A of FIG. 5.
Figure 5:
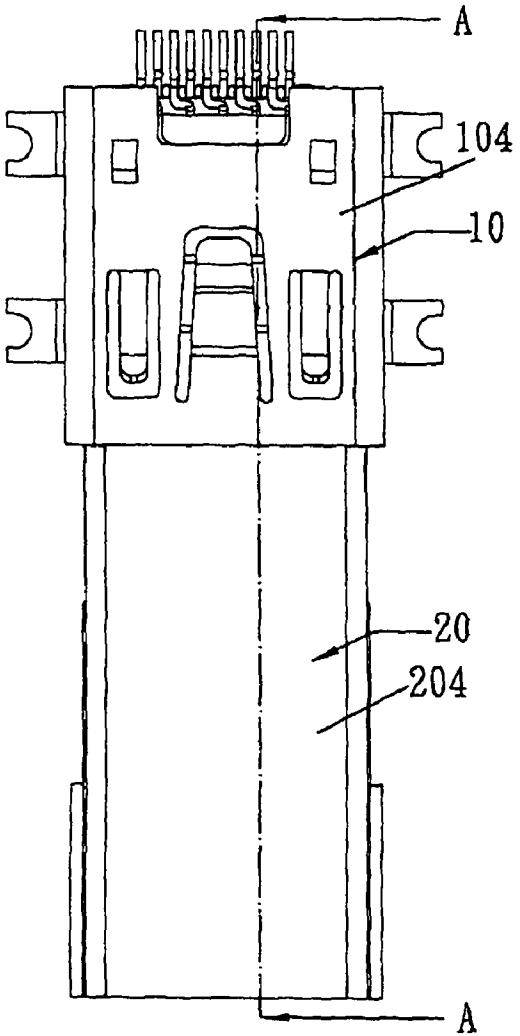
FIG. 5 is a top view of the connector assembly.

FIG. 2 includes an exploded view and an assembled view of a signal output connector 20 of the connector assembly according to the present invention. As shown in the drawing, the signal output connector 20 includes an insulation base 200 having a plurality of sockets C 200*a* and sockets D 200*b* spaced apart from and series-connected to one another and configured to receive a terminal set C 202 and a terminal set D 203 inserted and positioned therein, respectively. The signal output connector 20 further comprises a housing 204 mounted on the assembled insulation base 200 and the terminal sets 202, 203, so that the signal output connector 20 has a rear end thereof receiving a signal cable (not shown) of any transmission interface. Besides, an accommodating recess is defined at a front end of the insulation base 200, as shown in FIG. 4.

Referring to FIG. 3 and FIGS. 4 through 6 for the connector assembly formed by the assembled socket connector 10 and signal output connector 20. Therein, a front end of the signal output connector 20 is received in the accommodating recess defined between the housing 104 and the tongue portion 101 of the socket connector 10 while a front end of the base 100 and the tongue portion 101 of the socket connector 10 is received in the accommodating recess defined at the front end of the insulation base 200. At this time, the jutting portions 102*a* and 103*a* at the front ends of the terminal set A 102 and the terminal set B 103 of the socket connector 10 are in contact with front ends of the terminal set C 202 and the terminal set D 203 of the signal output connector 20 for signal transmission.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A connector assembly, comprising:

a socket connector including:

a base having:

a tongue portion extending frontward; and a plurality of first sockets and second sockets spaced apart from and series-connected to one another and extending through and across the base and the tongue portion;

a first terminal set and a second terminal set inserted and positioned in the first sockets and the second sockets, respectively, each of said first and second terminal sets being formed of individual terminals, each of said terminals having an arcuate first end section and a second end section having an L-shaped contour joined to said arcuate first end section; and a housing mounted on the assembled base and terminal sets, so that an accommodating recess is defined between the housing and the tongue portion, whereas said first and second sets of terminals are positioned and located partially external of said housing; and a signal output connector including:

an insulation base having a plurality of first signal output connector sockets and second signal output connector sockets spaced apart from and series-connected to one another;

a first signal output connector terminal set and a second signal output connector terminal set inserted and positioned in the sockets and the sockets, respectively; and a signal output connector housing mounted on the assembled insulation base and first and second signal output connector terminal sets, so that the signal output connector has a rear end thereof receiving a signal cable of any transmission interface and an accommodating recess is defined at a front end of the insulation base;

wherein the socket connector and the signal output connector are assembled together.

2. The connector assembly of claim 1, wherein the terminal set and the terminal set each have a plurality of terminals, and each of the terminals has a front end formed with an outward jutting portion and a rear end formed as a soldering pin.

3. The connector assembly of claim 2, wherein the socket connector and the signal output connector are assembled together such that a front end of the signal output connector is received in the accommodating recess defined between the housing and the tongue portion of the socket connector while a front end of the base and the tongue portion of the socket connector is received in the accommodating recess defined at the front end of the insulation base, so that the jutting portions at the front ends of the terminal set and the terminal set of the socket connector are in contact with front ends of the terminal set and the terminal set for signal transmission.

* * * * *